US008312734B2

(12) United States Patent
Lewis

(10) Patent No.: US 8,312,734 B2
(45) Date of Patent: Nov. 20, 2012

(54) CASCADING AIR-SOURCE HEAT PUMP

(76) Inventor: Donald C. Lewis, Brewer, ME (US)

( * ) Notice: Subject to any disclaimer, the term of this patent is extended or adjusted under 35 U.S.C. 154(b) by 1060 days.

(21) Appl. No.: 12/239,145

(22) Filed: Sep. 26, 2008

(65) Prior Publication Data

US 2010/0077788 A1 Apr. 1, 2010

(51) Int. Cl.
*F25B 7/00* (2006.01)
*F25B 27/00* (2006.01)
*F25D 17/00* (2006.01)

(52) U.S. Cl. ..... 62/335; 62/333; 62/238.7; 62/324.2

(58) Field of Classification Search ..... 62/335, 62/333, 238.7, 324.1, 324
See application file for complete search history.

(56) References Cited

U.S. PATENT DOCUMENTS

| | | | | |
|---|---|---|---|---|
| 3,301,002 | A | 1/1967 | McGrath | |
| 3,984,050 | A | 10/1976 | Gustafsson | |
| 4,149,389 | A | 4/1979 | Hayes et al. | |
| 4,236,876 | A | 12/1980 | Fraser et al. | |
| 4,268,291 | A | 5/1981 | Cann | |
| 4,391,104 | A | 7/1983 | Wendschlag | |
| 4,748,820 | A | 6/1988 | Shaw | |
| 4,787,211 | A | 11/1988 | Shaw | |
| 5,062,274 | A | 11/1991 | Shaw | |
| 5,236,311 | A | 8/1993 | Lindstrom | |
| 5,839,886 | A | 11/1998 | Shaw | |
| 5,927,088 | A | 7/1999 | Shaw | |
| 6,276,148 | B1 | 8/2001 | Shaw | |
| 6,615,602 | B2 | 9/2003 | Wilkinson | |
| 6,931,871 | B2 | 8/2005 | Shaw et al. | |
| RE39,625 | E | 5/2007 | Shaw | |
| 7,266,959 | B2 | 9/2007 | Lewis | |
| 2004/0255609 | A1 * | 12/2004 | Aflekt et al. | 62/498 |
| 2006/0168973 | A1 * | 8/2006 | Lewis | 62/175 |

FOREIGN PATENT DOCUMENTS

EP 1780476 A1 * 5/2007

* cited by examiner

*Primary Examiner* — Frantz Jules
*Assistant Examiner* — Cassey D Bauer
(74) *Attorney, Agent, or Firm* — Anthony D. Pellegrini, Esq.

(57) ABSTRACT

An improved air-source heat pump for residential and commercial use, employing two closed refrigerant systems having different refrigerants in cascade relationship to each other to address efficiency and space concerns, with the first closed refrigerant system partitionable into a first sub-system and a second sub-system, with the first sub-system working in conjunction with the second closed refrigerant system in heating mode and the second sub-system working independently in cooling mode.

24 Claims, 7 Drawing Sheets

CASCADING AIR-SOURCE HEAT PUMP

FIELD OF THE INVENTION

The invention relates generally to environmental climate control devices, namely, air-source heat pumps. Specifically, the invention relates to an improvement on cascading air-source heat pumps for residential and commercial use, where two closed refrigerant circuits are used with two different refrigerant fluids, in order to address efficiency and space concerns. Heating occurs with two circuits working in cascade fashion, with a heat output to an external heating system, such as a furnace or boiler or directly to a hot water or hot air line. Cooling occurs with the first closed circuit operating in reverse, using a separate input, such as an air plenum or an external cooling system, but using the same compressor and evaporator/condenser.

BACKGROUND

Air-source heat pumps are well known in the art. See, e.g., U.S. Pat. No. 6,615,602 (Wilkinson), which describes a typical air-source heat pump in detail. Air-source heat pumps incorporate a combination of compressors and condensers in a closed-loop system to draw heat energy from the outside environment for use in heating interior spaces. They can also be used in reverse to provide for air conditioning of interior spaces. Air-source heat pumps rely on well-known principles of thermodynamics to extract energy from a given volume of air.

As fossil fuels such as oil and natural gas continue to become scarcer, increased emphasis will be placed upon the use of electricity to provide space heating of homes and commercial buildings. Concerns are especially pertinent in cold weather areas such as New England. However, heat pump systems operating in cold weather environments often experience problems with efficiency. It is important to attain the highest level of efficiency as possible, as heat pumps that are more efficient save energy and money. A major problem that most heat pump systems experience is that, as the ambient outside temperature falls, the heating capacity of the heat pump system decreases drastically. Yet it is during these times of low temperatures that heating needs increase. In order to meet these needs, systems have utilized supplemental electrical resistance type heating, cascade technology, and boosters to increase their heating capacity so as to operate in low temperature environments.

A typical air-source heat pump is arranged with a "high side" and a "low side" configuration, wherein the system refrigerant is at a relatively high pressure and high temperature on the high side and is at a relatively low pressure and low temperature on the low side. Relatively low pressure/low temperature gaseous refrigerant from the low side is introduced into a compressor, which compresses the refrigerant into a high pressure/high temperature gas (compressing a given volume of gas into a smaller volume of gas causes its pressure and temperature to increase). The compressed high pressure/high temperature gas is then forced through a condenser which is in contact with the interior space to be heated; the gas gives up some of its energy in the condenser, thus providing heat to the interior space, and the refrigerant becomes liquefied. The liquid refrigerant is then forced through an expansion device which vaporizes the liquid into a low pressure/low temperature gas. Once the refrigerant has been vaporized into a low pressure/low temperature gas, it is passed through an evaporator which is in contact with the outside air. Heat energy is absorbed from the outside air by the refrigerant, which is then introduced to the compressor, repeating the cycle. The portion of the heat pump system between the compressor and the expansion device is the system high side, and the portion of the system from the evaporator back to the compressor is the system low side.

The foregoing is a simplified explanation of the mechanics of how an air-source heat pump works. However, it is sufficient to illustrate a phenomenon of thermodynamics which renders the typical air-source heat pump inefficient in cold climates. The maximum energy that can be extracted from a given volume of air by an air-source heat pump is its heating capacity. The heating capacity of an air-source heat pump changes with the temperature of the air from which energy is extracted. As the temperature of the outside air decreases, the expansion device pressurizes less of the refrigerant, resulting in the refrigerant having a lower density (and pressure) for a given volume to achieve a lower boiling point (since the boiling point of the refrigerant must be lower than the temperature of the ambient outside air). As the mass density of the refrigerant decreases eventually the flow of refrigerant will be below the operating capacity of the heat pump. Because air-source heat pumps are designed to handle a specific volume of flow, lowering the amount available lowers the overall heating capacity of the heat pump, because the system high side requires the refrigerant to be of a certain minimum pressure; when the refrigerant pressure is diminished due to decreasing outside air temperatures the compressor must raise the pressure of the refrigerant a greater degree. When the outside temperature becomes cold enough the corresponding pressure differential between the system low side and the system high side becomes too great for the compressor to overcome. To compensate, either compressors with far greater maximum capacity must be used, at great expense and inefficiency, or alternative heat sources must be available when the outside temperature falls too low. Neither of these solutions is practical and thus the use of typical air-source heat pumps is very limited in colder climates, where the need for heat is greatest during those winter months when the outside air is coldest and the resulting heating capacity is lowest.

A solution to the lack of efficiency of cold climate air-source heat pumps was demonstrated by Gustafsson, involving the use of cascade-connected heat pumps. See, e.g., U.S. Pat. No. 3,984,050 (Gustafsson). Cascading heat pumps are well known in the art. Gustafsson describes a heat pump system capable of extracting heat from relatively low temperature ambient air (−10° C.) to produce hot water (up to 80° C.). Air-source heat pump systems set up in a cascade fashion use the condenser unit of one heat pump arranged in a heat-exchanging relationship with the evaporator of the other heat pump. This "piggy-back" relationship increases the system's efficiency, i.e., the ratio between the output energy and the input energy. However, while the Gustafsson device and similar systems are able to reach temperatures high enough to produce hot water, they do not also provide air conditioning.

A cascading heat pump system capable of operating over a wide range of source temperature and of providing supplemental comfort zone air conditioning was disclosed in U.S. Pat. No. 4,391,104 (Wendschlag). The Wendschlag heat pump system uses a first refrigerant fluid and a second refrigerant fluid with separate compression cycle loops passing in heat transfer relationship through a tri-fluid heat exchanger. Having separate circuits allows several different types of refrigerant to be used, which is beneficial because different types of refrigerant are effective under different conditions. This setup also allows the system to operate in several different modes, incorporating a method for selectively heating water by extracting heat from relatively cold outdoor ambient air in cascade, and for heating or cooling air supplied to a comfort zone in non-cascade fashion. Although the Wendschlag system, and others like it, work efficiently in cold weather, they are not effective when it comes to providing air conditioning during periods of warm temperatures. The air conditioning provided by Wendschlag is only supplemental and occurs only as a by-product of heating water. This prevents Wendschlag and similar systems from being efficient sources of comfort zone temperature conditioning, and necessitate that a separate air conditioning system be used in order to provide efficient and sufficient cold air during warm weather months.

One solution to the problem of cold climate heat pumps which also efficiently provide air conditioning was demonstrated in U.S. Pat. No. 4,149,389 (Hayes, et al.). Hayes, et al., uses either a cascading or non-cascading mode to send hot air into the conditioned space. The non-cascade heating mode also operates in reverse in order to provide non-supplemental air conditioning to the conditioned space. However, the Hayes, et al., device is not set up to run an external heating system and a separate external cooling system. Rather, the output heat energy is exhausted through an air plenum into the ambient interior air, which also serves as the location for the provision of air conditioning. The Hayes, et al., system is therefore impractical for application with existing heating systems or where more efficient heating systems are desired.

It is therefore an object of the invention to provide an improved air-source heat pump which operates efficiently in cold climates.

It is a further object of the invention to provide an improved air-source heat pump which incorporates the efficiencies of a cascading dual refrigerant circuit heating system.

It is yet a further object of the invention to provide an improved air-source heat pump which incorporates the efficiencies of a cascading heating system with a non-cascading cooling system.

It is yet a further object of the invention to provide an improved air-source heat pump which incorporates different refrigerants to increase the operational temperature range of the device.

It is yet a further object of the invention to provide an improved air-source heat pump which efficiently integrates with a furnace or a boiler.

It is yet a further object of the invention to provide an improved air-source heat pump which efficiently integrates directly with a hot water line or a hot air line.

It is yet a further object of the invention to provide an improved air-source heat pump which efficiently integrates directly with a cold water line or a cold air line.

It is yet a further object of the invention to provide an improved air-source heat pump wherein the components of a cascading dual refrigerant circuit are simplified resulting in the overall efficiency of the system being maximized and the time and effort for installation being minimized.

Other objects of this invention will be apparent to those skilled in the art from the description and claims which follow.

SUMMARY

The present invention discloses an improved air-source heat pump heater/air conditioner, using two separate closed loop refrigerant circuits which interact with each other through a first heat exchanger and which further interact with an external heating system through a second heat exchanger. In heating mode, the two refrigerant circuits work together in cascade relation, with heat output to the external heating system, such as a hot air furnace or a hot water boiler or directly with a hot water line or a hot air line. In cooling mode, the first closed refrigerant circuit operation is reversed and the second refrigerant circuit is nonoperational.

Each of the two closed refrigerant circuits uses a different type of refrigerant fluid, with the first refrigerant circuit using a relatively high pressure, low temperature refrigerant such as R22 or R410A, and the second refrigerant circuit using a relatively low pressure, high temperature refrigerant such as R134A or R236. The use of different refrigerants allows the device to work in cold climates while also producing sufficient heat to boil water.

In heating mode, a first compressor circulates the first refrigerant fluid through a portion of the first refrigerant circuit, partitioned from the remainder of the circuit by appropriate valving. The vaporized first refrigerant fluid passes through an evaporator/condenser exposed to the outside environment, whereby heat energy is absorbed by the first refrigerant fluid. The vaporized first refrigerant fluid is then compressed by the first compressor into a high/pressure/high temperature gas and passed through a first heat exchanger, where heat energy contained in the first refrigerant circuit is transferred to the second refrigerant circuit. In giving up some of its heat energy in the first heat exchanger, the first refrigerant fluid becomes liquefied. The liquid first refrigerant is then passed through an expansion device which revaporizes the liquid into a low pressure/low temperature gas, which is then directed to the evaporator/condenser to repeat the cycle.

The use of a relatively high pressure, low temperature refrigerant allows heat energy to be extracted from the outside environment at low temperatures. The use of an unloadable compressor further expands the operational temperature range of the compressor, allowing it to efficiently operate at ever lower temperatures. However, due to practical constraints of the compressor, the ultimate amount of heat energy absorbed by the first refrigerant when the outside ambient temperature is low is insufficient to adequately provide sufficient heat to the external heating system. Therefore, the second refrigerant circuit is employed to augment the available heat.

The second refrigerant circuit utilizes a second compressor to circulate the second refrigerant fluid. The vaporized second refrigerant fluid passes through the first heat exchanger to absorb heat energy from the first refrigerant circuit. The vaporized second refrigerant fluid is then compressed by the second compressor into a high pressure/high temperature gas and passed through a second heat exchanger, where heat energy contained in the second refrigerant circuit is transferred to the external heating system, resulting in the second refrigerant fluid liquefying. The second refrigerant is then passed through an expansion device to revaporize it into a low pressure/low temperature gas, which is then directed to the first heat exchanger to repeat the cycle.

In cooling mode, the first compressor circulates the first refrigerant fluid through the first refrigerant circuit in the opposite direction from heating mode. A different portion of the first refrigerant circuit, which extends to the space to be cooled and which is not involved in the heating cycle, is made accessible through appropriate valving. The vaporized first refrigerant fluid passes through an evaporator located in the space to be cooled, extracting heat energy from the inside environment. The vaporized first refrigerant fluid is then compressed by the first compressor and passed through the evaporator/condenser, where heat energy contained in the first refrigerant circuit is exhausted to the outside environment and the first refrigerant fluid liquefies. The first refrigerant is then passed through an expansion device to revaporize and then is directed to the evaporator to repeat the cycle. During cooling mode the first heat exchanger is bypassed by appropriate valving.

The cooling mode may also be used in conjunction with the heating mode to perform a defrost cycle of the coils of the evaporator/condenser. During heating mode, especially when the outside ambient temperature is low, the evaporator/condenser coils tend to ice up, preventing efficient extraction of heat energy. During cooling mode heat energy is exhausted to the outside environment through the evaporator/condenser coils. By periodically switching from heating mode to cooling mode, the evaporator/condenser coils can be efficiently defrosted. Other means of performing a defrost cycle may also be used, such as heating the coils with external heat sources.

Because the first refrigerant circuit is partitioned into a first sub-circuit to be used for heating and a second sub-circuit to be use for cooling, the same compressor and evaporator/condenser can be used for both functions, improving the overall efficiency of the device. And because the output from the heating mode is separated from the space to be cooled in cooling mode, the device can be easily retrofitted to existing hot air furnace systems or hot water boiler systems as well as added to heating systems without furnaces or boilers but rather employing direct hot water or hot air lines for rapid heating response, while also providing air conditioning functionality.

Other features and advantages of the invention are described below.

DETAILED DESCRIPTION OF THE INVENTION

Figure 1:
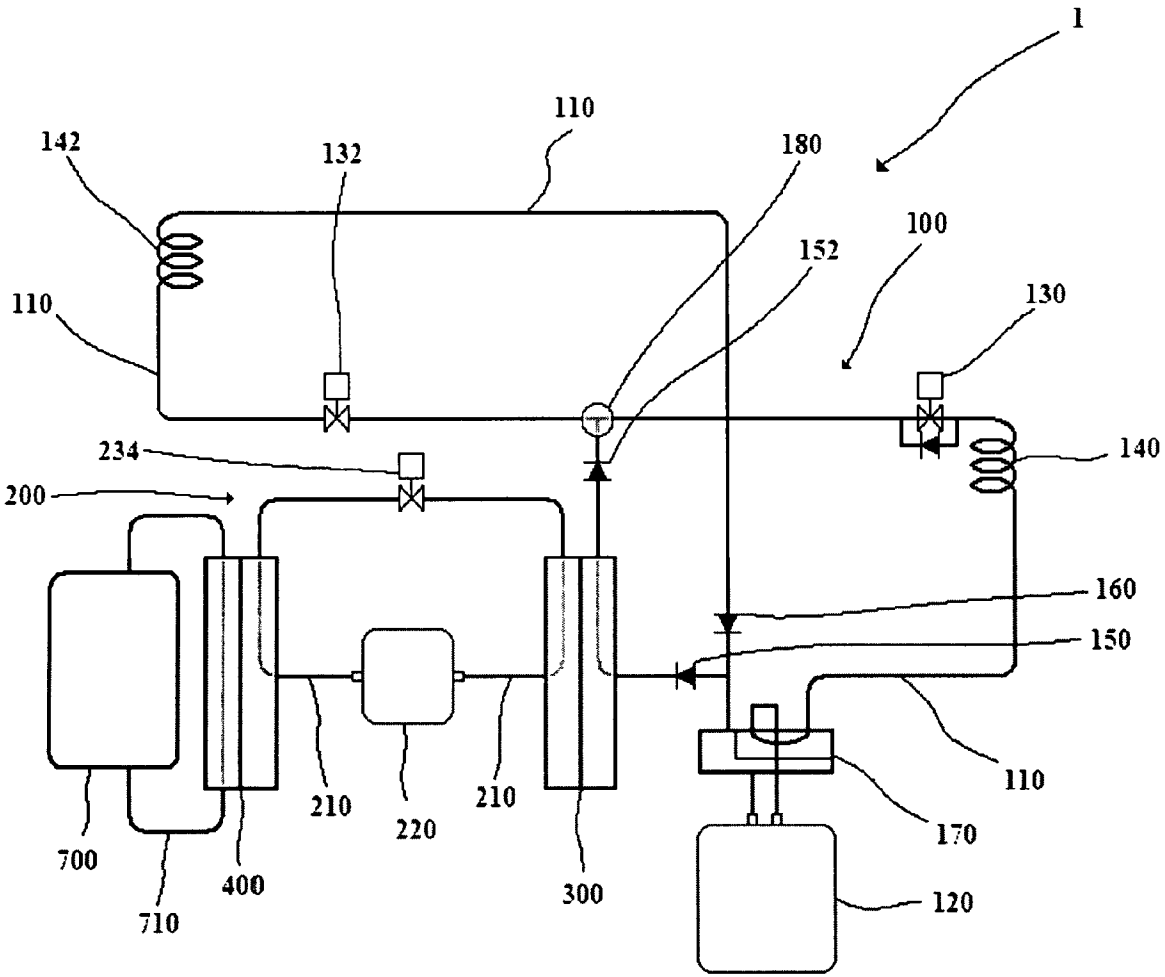
FIG. 1 is a schematic depiction of the heat pump of the present invention.
Figure 2A:
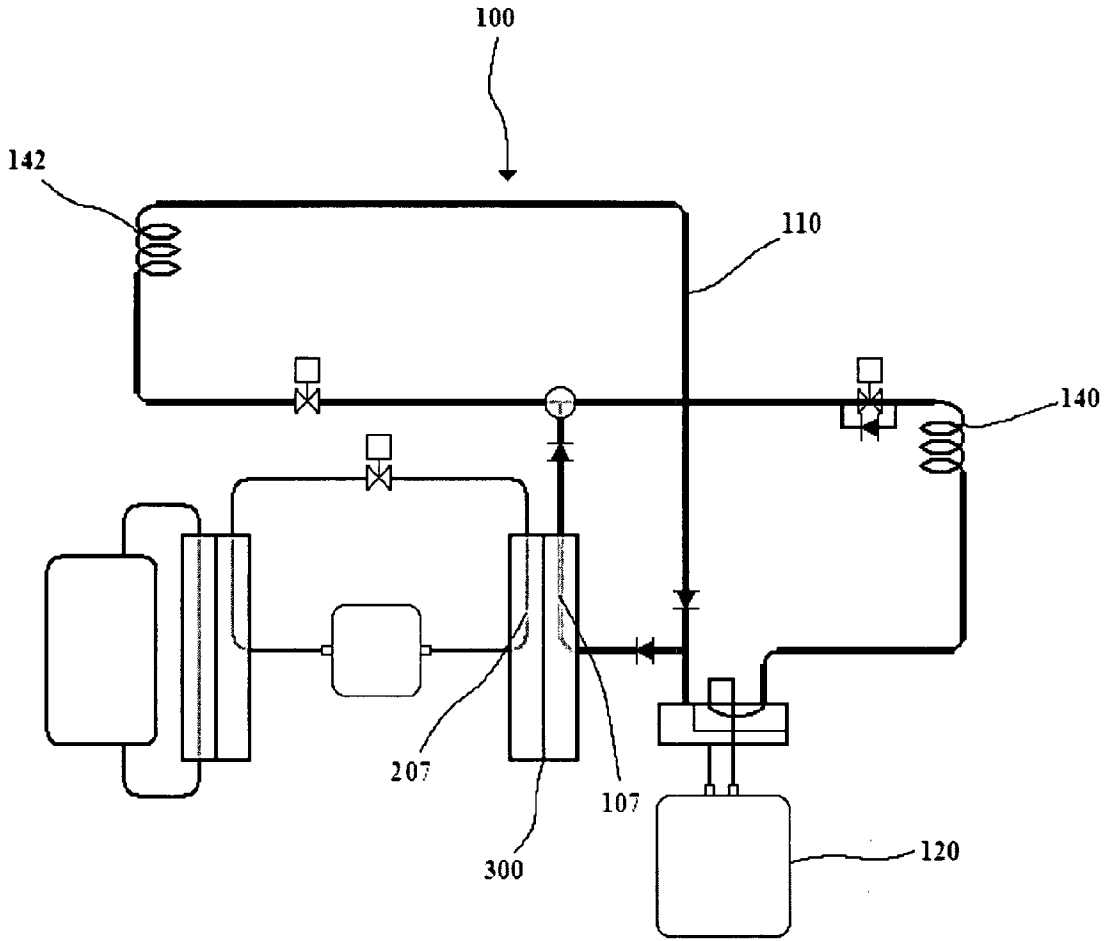
FIG. 2A is a schematic depiction of the heat pump of the present invention with the first refrigerant circuit emphasized.
Figure 2B:
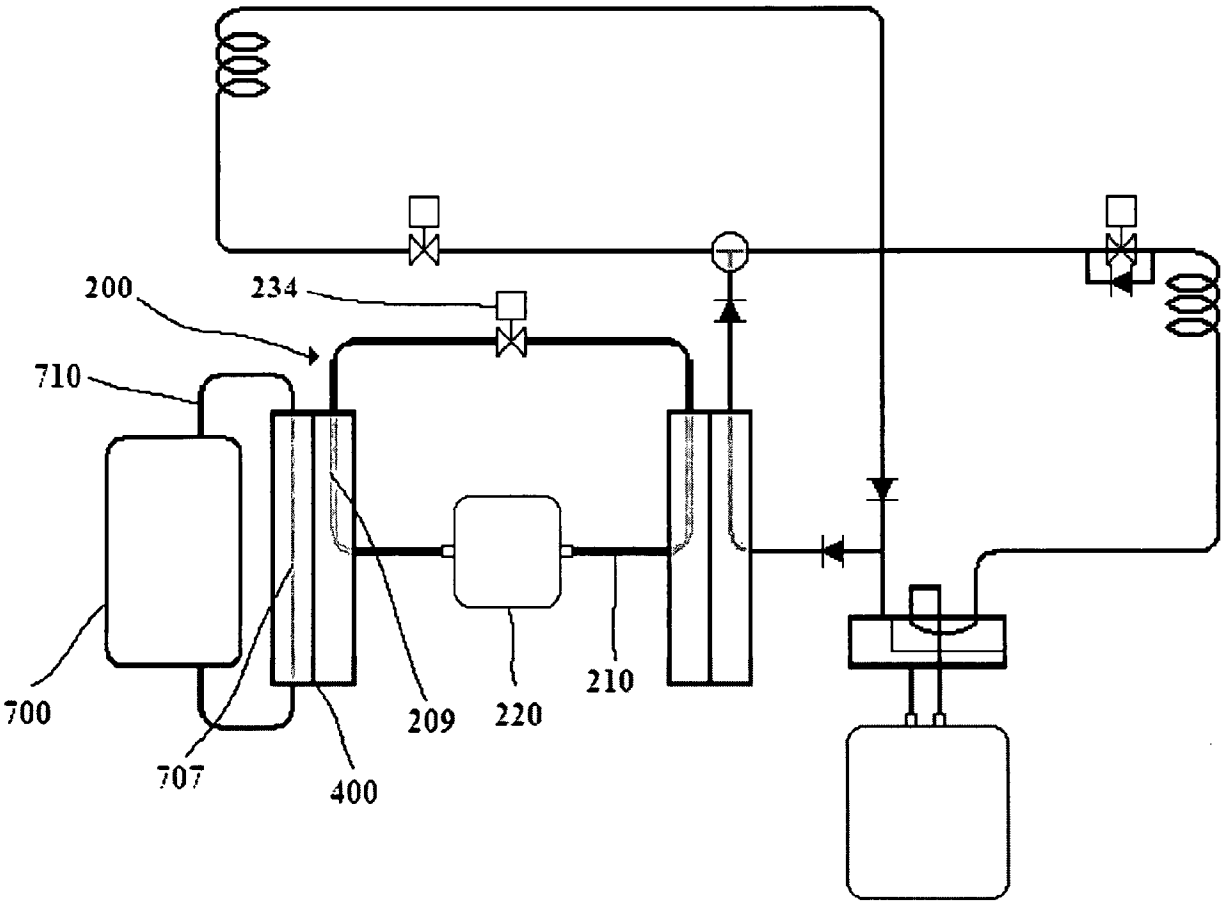
FIG. 2B is a schematic depiction of the heat pump of the present invention with the second refrigerant circuit emphasized.

The present invention discloses an improved heat pump 1 comprising a first closed refrigerant circuit 100 containing a first refrigerant fluid, see FIG. 2A, and a second closed refrigerant circuit 200 containing a second refrigerant fluid, see FIG. 2B, the first and second refrigerant circuits 100,200 being in cascade relationship with each other, wherein the improved heat pump 1 is operable both in a heating mode and in a cooling mode. The cascade relationship is achieved by the improved heat pump 1 having a first heat exchanger 300 interposed between and in connection with the first refrigerant circuit 100 and the second refrigerant circuit 200 and a second heat exchanger 400 interposed between and in connection with the second refrigerant circuit 200 and an external heating system 700. See FIG. 1.

The first refrigerant fluid is selected from the group of known refrigerant fluids having a relatively high pressure at a given temperature and able to efficiently extract heat energy from air at relatively low temperatures, while the second refrigerant fluid is selected from the group of known refrigerant fluids having a relatively lower pressure at a given temperature than that of the first refrigerant fluid and able to efficiently achieve higher temperatures than the first refrigerant fluid. The combined use of the first and second refrigerant fluids expands the operating range of the improved heat pump 1 to permit efficient operation at very low environmental temperatures while achieving high heat output. The first refrigerant fluid may be the well-known refrigerant R22 or R410A. The second refrigerant fluid may be the well-known refrigerant R134A or R236. Use of other refrigerants having the characteristics of the first and second refrigerant fluids described herein are also contemplated by the present invention.

Figure 3A:
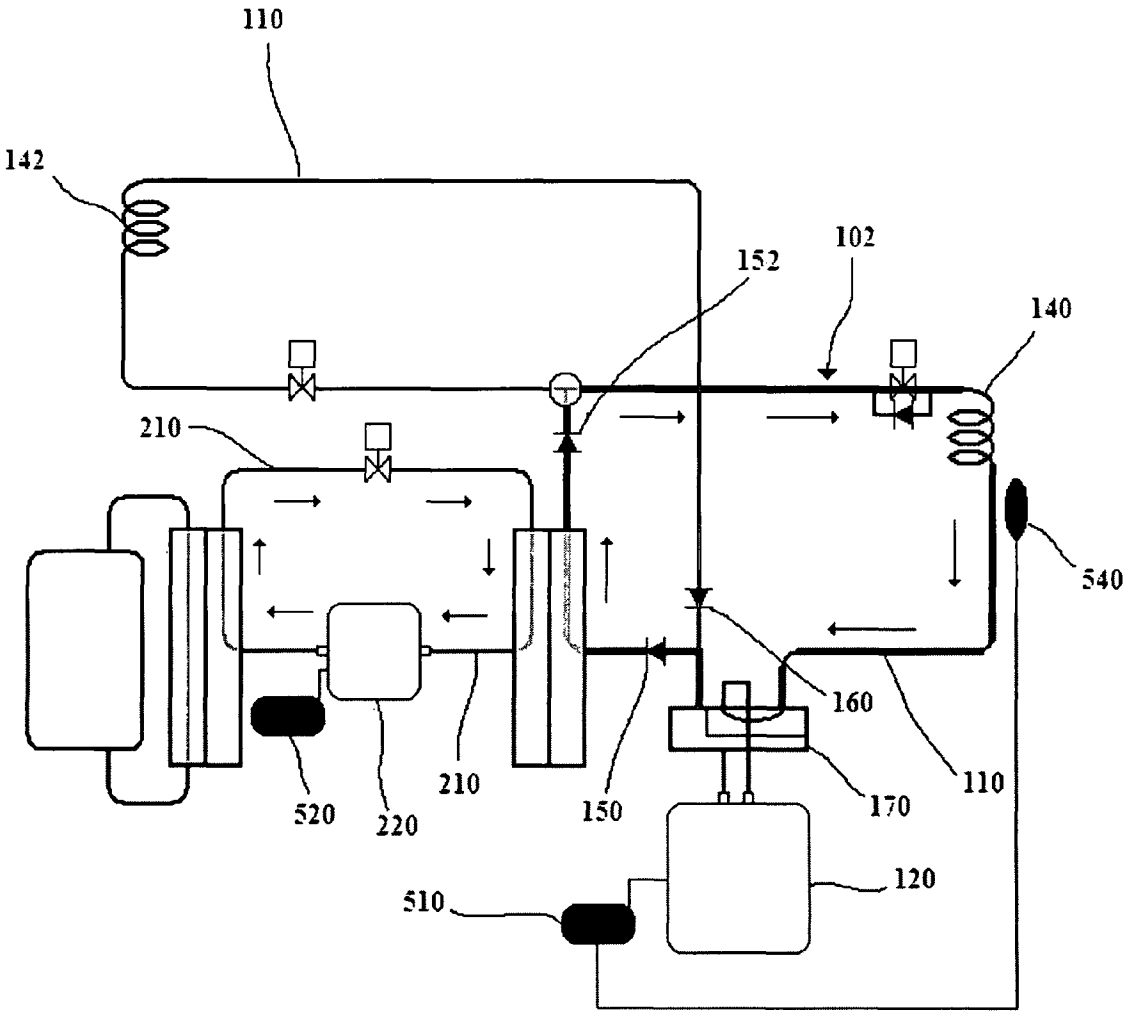
FIG. 3A is a schematic depiction of the heat pump of the present invention with the first sub-circuit of the first refrigerant circuit emphasized. Directional arrows are included along the flow conduits of the first and second refrigerant circuits to indicate the direction of flow of refrigerant fluid during heating mode.
Figure 3B:
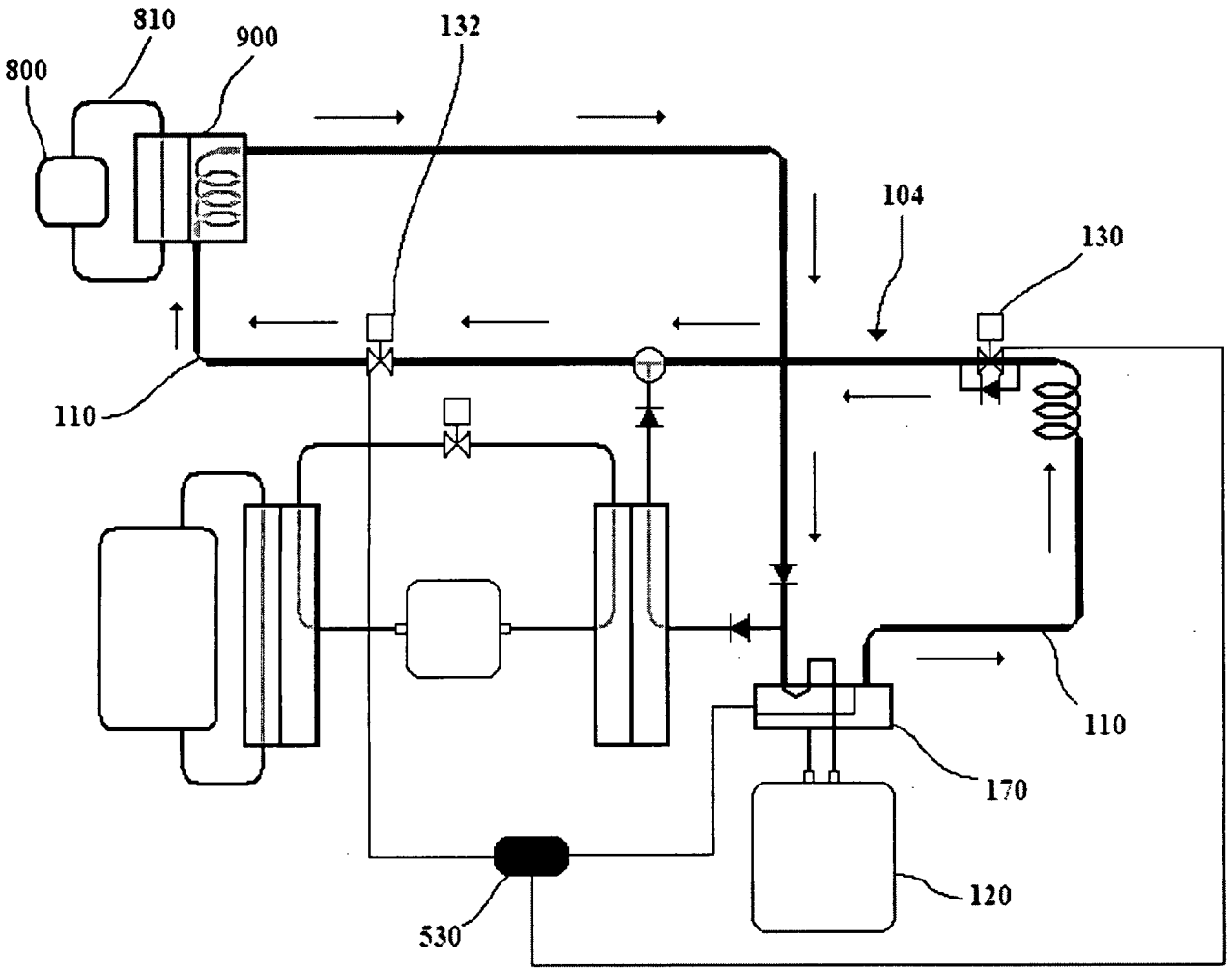
FIG. 3B is a schematic depiction of the heat pump of the present invention with the second sub-circuit of the first refrigerant circuit emphasized. Directional arrows are included along the flow conduit of the first refrigerant circuit to indicate the direction of flow of refrigerant fluid during cooling mode. An alternative embodiment of the external cooling system to which the heat pump is connected is also shown.

The first refrigerant circuit 100 is comprised of a first sub-circuit 102 and a second sub-circuit 104, with the first sub-circuit 102 of the first refrigerant circuit 100 operable in heating mode and the second sub-circuit 104 of the first refrigerant circuit 100 operable in cooling mode. See FIGS. 3A, 3B. When the improved heat pump 1 is operable in heating mode the first refrigerant fluid circulates through the first sub-circuit 102 of the first refrigerant circuit 100 in a first direction, see FIG. 3A, and when the improved heat pump 1 is operable in cooling mode the first refrigerant fluid circulates through the second sub-circuit 104 of the first refrigerant circuit 100 in a second direction, see FIG. 3B. The first sub-circuit 102 is comprised of a portion of the first refrigerant circuit 100 and the second sub-circuit 104 is comprised of a different portion of the first refrigerant circuit 100, whereby at least some sections of the portions of the first refrigerant circuit 100 do not overlap with each other. The use of different sub-circuits within a single refrigerant circuit for the different modes of operation of the improved heat pump 1 increases its efficiency and ability to be retrofitted into existing construction, as well as used in new construction.

The first refrigerant circuit 100 of the improved heat pump 1 also comprises a first flow conduit 110. See FIG. 2A. The first flow conduit 110 is a closed loop suitably adapted to contain the first refrigerant fluid, such that the first refrigerant fluid may flow in a continuous cycle through the first flow conduit 110. The first flow conduit 110 may therefore be constructed of any manner of suitable tubing or piping, whether rigid or flexible. It may be comprised of any suitable material, such as copper or PEX (cross-linked polyethylene).

The first refrigerant circuit 100 comprises a first compressor 120, integrated with the first flow conduit 110. See FIG. 2A. The first compressor 120 is suitably adapted to compress the first refrigerant fluid, which is introduced to the first compressor 120 as a relatively low pressure/low temperature gas and which is compressed by the first compressor 120 into a high pressure/high temperature gas. The first compressor 120 ideally is unloadable. In one embodiment the first compressor 120 is oversized, and may run at fifty percent or one hundred percent capacity. The capacity of the first compressor 120 is determined in relation to the temperature of the outside environment; where the outside environment temperature is extremely low, the available heat energy in the air is less and the first compressor 120 operates at full capacity. When the temperature of the outside environment is moderate there is more heat energy in the air and the first compressor 120 operates at partial capacity. Other partial capacities are also contemplated. In yet other embodiments, the improved heat pump 1 utilizes one or more staged auxiliary compressors 121 to operate in parallel with the first compressor 120. The number of auxiliary compressors 121 operating at any given time will depend on the temperature of the outside environment, with more compressors 121 operating the colder the temperature of the outside environment.

The first refrigerant circuit 100 also includes a first expansion device 130, an evaporator/condenser 140, a second expansion device 132, a second evaporator 142, and a reversing valve 170. The first sub-circuit 102 of the first refrigerant circuit 100 comprises a first portion of the first flow conduit 110, the first compressor 120, the reversing valve 170, the first expansion device 130, and the evaporator/condenser 140. See FIG. 3A. The first compressor 120, the reversing valve 170, the first expansion device 130, and the evaporator/condenser 140 are in respective serial fluid communication with one another in the first sub-circuit 102, permitting the first refrigerant fluid to circulate in a closed loop in the first direction within the first sub-circuit 102. The second sub-circuit 104 of the first refrigerant circuit 100 comprises a second portion of the first flow conduit 110, the first compressor 120, the reversing valve 170, the evaporator/condenser 140, the second expansion device 132, and the second evaporator 142. See FIG. 3B. The first compressor 120, the reversing valve 170, the evaporator/condenser 140, the second expansion device 132, and the second evaporator 142 are in respective serial fluid communication with one another in the second sub-circuit 104, permitting the first refrigerant fluid to circulate in a closed loop in the second direction within said second sub-circuit 104. At least some part of the second portion of the first flow conduit 110 is not coterminous with at least some part of the first portion of the first flow conduit 110. The use of several of the same elements in both the first sub-circuit 102 and the second sub-circuit 104 reduces redundancy and increases the cost-effectiveness of the improved heat pump 1. In some embodiments of the present invention the first refrigerant circuit 100 may also include one or more refrigerant expansion tanks 180, with at least one refrigerant expansion tank 180 located within the first sub-circuit 102 and within the second sub-circuit 104. The refrigerant expansion tank 180 compensates for the various volumes of refrigerant fluid needed during the different modes of operation. For example, during cooling mode, the evaporator/condenser 140 will hold more first refrigerant fluid than will be held by the first heat exchanger 300 during heating mode. When the mode of operation switches from heating to cooling, the first refrigerant circuit 100 needs more first refrigerant fluid to operate properly. The differential amount of first refrigerant fluid is stored in the refrigerant expansion tank 180.

The second refrigerant circuit 200 of the improved heat pump 1 comprises a second flow conduit 210. See FIG. 2B. The second flow conduit 210 is a closed loop suitably adapted to contain the second refrigerant fluid, such that the second refrigerant fluid may flow in a continuous cycle through the second flow conduit 210. The second flow conduit 210 may be of the same configuration and be constructed of the same materials as the first flow conduit 110. The second refrigerant circuit 200 also comprises a second compressor 220, integrated with the second flow conduit 210. The second compressor 220 is suitably adapted to compress the second refrigerant fluid, which is introduced to the second compressor 220 as a relatively low pressure/low temperature gas and which is compressed by the second compressor 220 into a high pressure/high temperature gas. Unlike the first compressor 120, the second compressor 220 need not be unloadable and ideally is a simple, single capacity compressor. The second refrigerant circuit 200 also includes a third expansion device 234, whereby the second compressor 220 and the third expansion device 234 are in respective serial fluid communication with one another. The second compressor 220 circulates the second refrigerant fluid in a closed loop within the second flow conduit 210 of the second refrigerant circuit 200. The second refrigerant circuit 200 is operable in heating mode only.

The first refrigerant circuit 100 and the second refrigerant circuit 200 are in cascade relation with each other through the first heat exchanger 300. The first heat exchanger 300 is interposed between and in connection with the first refrigerant circuit 100 and the second refrigerant circuit 200. The first heat exchanger 300 contains a first section 107 of the first refrigerant circuit 100 and a first section 207 of the second refrigerant circuit 200 in close proximity to each other within the first heat exchanger 300, such that heat energy carried by the first refrigerant fluid circulating within the first refrigerant circuit 100 is capable of being transferred to the second refrigerant fluid circulating within the second refrigerant circuit 200. See FIG. 2A. The first section 107 of the first refrigerant circuit 100 may be adjacent to and in contact with the first section 207 of the second refrigerant circuit 200, or there may be a conductive element interposed between them to assist in heat transfer. The first section 107 of the first refrigerant circuit 100 and the first section 207 of the second refrigerant circuit 200 may be configured as straight piping, or coils, or any other configuration that allows for efficient heat transfer. The first heat exchanger 300 may utilize an insulated housing that contains the first section 107 of the first refrigerant circuit 100 and the first section 207 of the second refrigerant circuit 200. Other configurations of the first heat exchanger 300 are also contemplated, as long as the first refrigerant fluid and the second refrigerant fluid remain physically separated from each other within the first heat exchanger 300.

The second refrigerant circuit 200 and the external heating system 700 are in cascade relation with each other through the second heat exchanger 400. The second heat exchanger 400 is interposed between and in connection with the second refrigerant circuit 200 and the external heating system 700. The second heat exchanger 400 contains a second section 209 of the second refrigerant circuit 200 and a first section 707 of the external heating system 700 in close proximity to each other within the second heat exchanger 400, such that heat energy carried by the second refrigerant fluid circulating within the second refrigerant circuit 200 is capable of being transferred to either the water or air contained within the external heating system 700. See FIG. 2B. The portion of the external heating system 700 which comprises the first section 707 of the external heating system 700 is the heating system interface 710. The heating system interface 710 connects to the remainder of the external heating system 700, which may be a standard hot water boiler, hot air furnace, direct forced hot water system, direct forced hot air system, or any other conventional heating system. The heating system interface 710 may be a standard component of the external heating system 700 or a new component integrated with the external heating system 700 and specially designed to provide an interface with the improved heat pump 1. The configuration of the second section 209 of the second refrigerant circuit 200 and the first section 707 of the external heating system 700 within the second heat exchanger 400 is analogous to the configuration of the first section 107 of the first refrigerant circuit 100 and the first section 207 of the second refrigerant circuit 200 within the first heat exchanger 300. The second heat exchanger 400 may utilize an insulated housing that contains the second section 209 of the second refrigerant circuit 200 and the first section 707 of the external heating system 700. Other configurations of the second heat exchanger 400 are also contemplated, as long as the second refrigerant fluid and the heat transfer medium of the external heating system 700 remain physically separated from each other within the second heat exchanger 400.

The reversing valve 170 of the first refrigerant circuit 100 is in fluid communication with and interposed between the first flow conduit 110 and the first compressor 120. See FIG. 1. The reversing valve 170 is capable of being movably positioned between a first position and a second position to control the direction of flow of the first refrigerant fluid through the first flow conduit 110. The first refrigerant fluid flows through the first flow conduit 110 in the first direction when the reversing valve 170 is in the first position and the first refrigerant fluid flows through the first flow conduit 110 in the second direction when the reversing valve 170 is in the second position. The position of the reversing valve 170 may controlled by one or more controllers 530. See FIG. 3B. The controller 530 may be a logic controller, such as an integrated circuit incorporated within a printed circuit board.

In addition to the reversing valve 170, other valving may be present within the first refrigerant circuit 100 to direct the flow of the first refrigerant fluid in either the first direction or the second direction. In one embodiment the improved heat pump 1 comprises a first check valve 150, a second check valve 152, and a third check valve 160, with all three check valves 150,152,160 located within the first flow conduit 110. See FIG. 1. Each check valve 150,152,160 permits the flow of the first refrigerant fluid through it in a single direction, with the first and second check valves 150,152 permitting the flow of the first refrigerant fluid in the first direction only and the third check valve 160 permitting the flow of the first refrigerant fluid in the second direction only. In this embodiment each expansion device 130,132,234 may be a thermal expansion valve, an electronic expansion valve, capillary tubing, orifice tubing, or a mechanical expansion valve with bypass. Each expansion device 130,132,234 may also comprise a solenoid valve for controlling flow if such capability is not otherwise integrated within its functionality. The first expansion device 130 has an open state and a closed state, each state controlled either by integrated functionality or governed by the solenoid valve, whereby when the first expansion device 130 is in the open state the flow of the first refrigerant fluid through it is permitted in the first direction, and when the first expansion device 130 is in the closed state the flow of the first refrigerant fluid bypasses expansion. The second expansion device 132 also has an open state and a closed state, similarly controlled, whereby when the second expansion device 132 in the open state the flow of the first refrigerant fluid through it is permitted in the second direction, and when the second expansion device 132 is in the closed state the flow of the first refrigerant fluid through it is prevented. When the reversing valve 170 is in the first position, the first expansion device 130 is in the open state, and the second expansion device 132 is in the closed state the first sub-circuit 102 of the first refrigerant circuit 100 is operable and the first refrigerant fluid circulates in a closed loop in the first direction within the first sub-circuit 102. When the reversing valve 170 is in the second position, the first expansion device 130 is in the closed state, and the second expansion device 132 is in the open state the second sub-circuit 104 of the first refrigerant circuit 100 is operable and the first refrigerant fluid circulates in a closed loop in the second direction within the second sub-circuit 104. The states of the first expansion device 130 and the second expansion device 132 may controlled by one or more controllers 530, which may be logic controllers. See FIG. 3B.

The operation of the first compressor 120 and the second compressor 220 may be controlled by one or more controllers 510,520. See FIG. 3A. The controllers 510,520 may be logic controllers. In the preferred embodiment where the first compressor 120 is unloadable, the improved heat pump 1 also comprises a sensor 540 for sensing environmental temperatures proximate to the evaporator/condenser 140. The sensor 540 may be an electronic temperature sensing device. The sensor 540 is in communication with the controller 510 and the controller 510 is responsive to input from the sensor 540. When the controller 510 receives input from the sensor 540 indicating the environmental temperature proximate to the evaporator/condenser 140 has reached a first predetermined level, the controller 510 operates the first compressor 120 at a first capacity. When the controller 510 receives input from the sensor 540 indicating the environmental temperature proximate to the evaporator/condenser 140 has reached a second predetermined level, the controller 510 operates the first compressor 120 at a second capacity. As an example, the first predetermined level may be 40 degrees Fahrenheit; when the outside temperature is sensed to fall below this temperature, the first compressor 120 operates at 100% capacity. When the outside temperature is sensed to rise above the second predetermined level (ideally somewhat higher than the first predetermined level, to minimize cycling), the first compressor 120 operates at 50% capacity.

Figure 4:
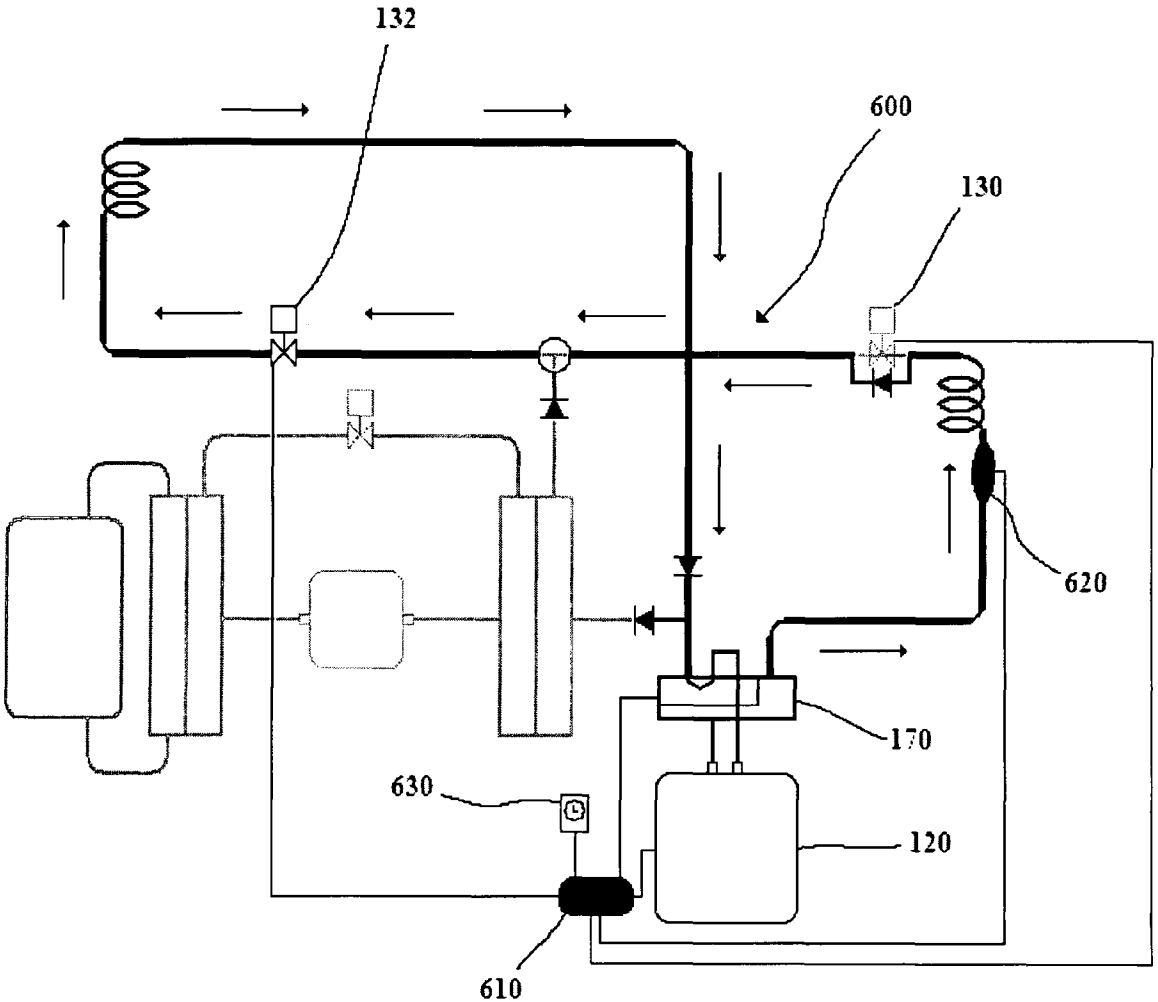
FIG. 4 is a schematic depiction of the heat pump of the present invention with one embodiment of the defrost means emphasized. Directional arrows are included along the flow conduit of the second sub-circuit of the first refrigerant circuit to indicate the direction of flow of refrigerant fluid during defrost mode.
Figure 5:
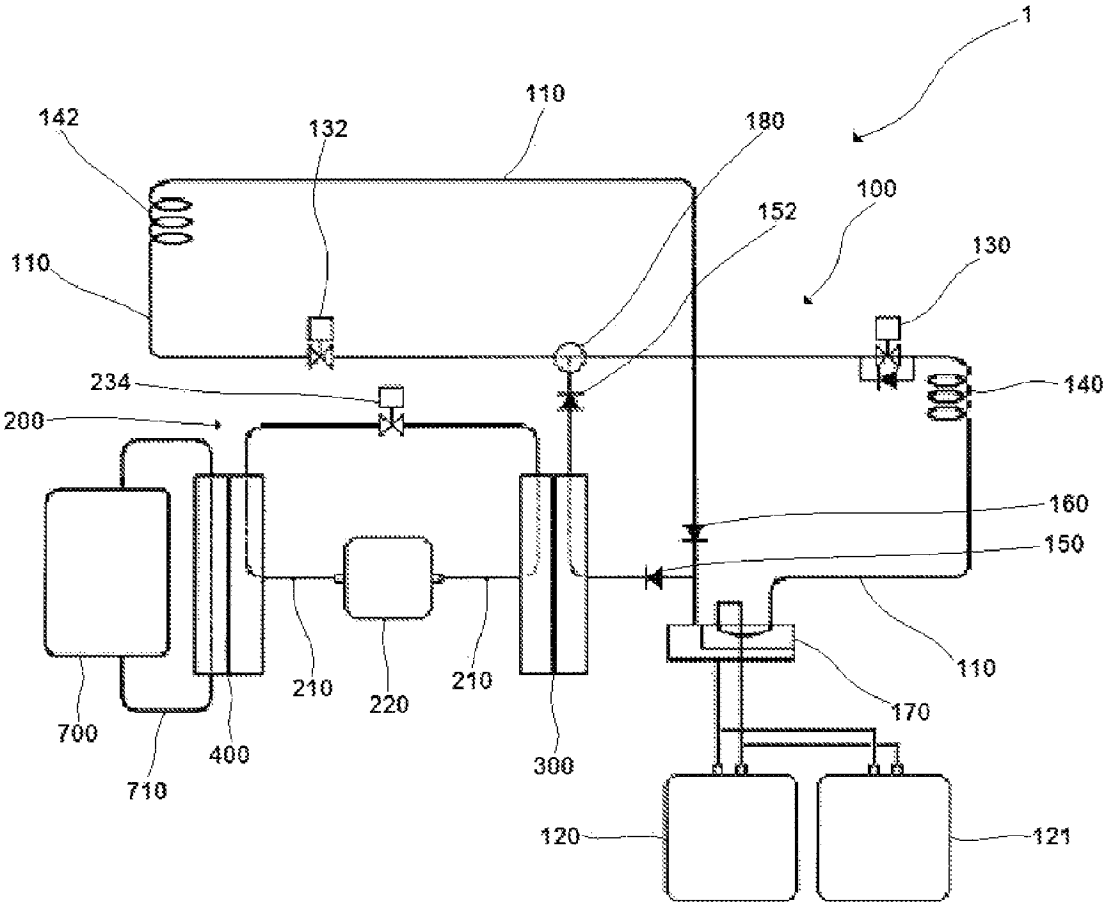
FIG. 5 is a schematic depiction of the heat pump of the present invention depicting an embodiment using a parallel compressor in conjunction with the first compressor.

A known downside to using air-source heat pumps in cold climates is the potential for moisture to freeze onto the evaporator. As ice and frost accumulate onto the evaporator's coils, the transfer of heat becomes less efficient, degrading the entire system's performance. The improved heat pump 1 of the present invention comprises a defrosting means 600 sufficient to eliminate ice buildup from the evaporator/condenser 140. See FIG. 4.

One embodiment of the defrosting means 600 of the improved heat pump 1 periodically reverses the flow of the first refrigerant fluid within the first refrigerant circuit 100 (as is done when the improved heat pump 1 is used in cooling mode), thereby sending heated refrigerant fluid through the evaporator/condenser 140, which then discharges rather than absorbs heat energy, thus defrosting the coils. After allowing the coils to defrost, the flow of the first refrigerant fluid is reversed to permit the first refrigerant fluid to absorb heat energy from the outside air.

In one embodiment of this defrosting means 600, the flow of the first refrigerant fluid through the first refrigerant circuit 100 is controlled by one or more controllers 610, which may be logic controllers, which are suitably adapted to control the states of the first and second expansion devices 130,132, the position of the reversing valve 170, and operation of the first compressor 120. The defrosting means 600 utilizes a sensor 620 for sensing temperatures of the first refrigerant fluid proximate to the evaporator/condenser 140 and a timer 630, both of which are in communication with at least one of the one or more controllers 610. When the one or more controllers 610 receive input from the sensor 620 indicating the temperature of the first refrigerant fluid proximate to the evaporator/condenser 140 has reached a predetermined level, the controllers 610 activate the timer 630 for a predetermined period of time, set the states of the first and second expansion devices 130,132, set the position the reversing valve 170 to place the improved heat pump 1 in cooling mode, and operate the first compressor 120 such that the first refrigerant fluid flows through the second sub-circuit 104 of the first refrigerant circuit 100 in the second direction until the predetermined period of time as measured by the timer 630 elapses. Thereafter, the controllers 610 reverse the respective states of the first and second expansion devices 130,132 and the position of the reversing valve 170 to place the improved heat pump 1 in heating mode and operate the first compressor 120 such that the first refrigerant fluid flows through the first sub-circuit 102 of the first refrigerant circuit 100 in the first direction.

In another embodiment of this defrosting means 600, rather than operating for a predetermined period of time governed by a timer, the defrosting means 600 initiates the defrost cycle when the sensor 620 determines the temperature of the first refrigerant fluid proximate to the evaporator/condenser 140 has fallen to a first predetermined level and terminates the defrost cycle when the sensor 620 determines the temperature of the first refrigerant fluid proximate to the evaporator/condenser 140 has risen to a second predetermined level. The second predetermined level is ideally somewhat higher than the first predetermined level to minimize cycling.

An alternative embodiment of the defrosting means 600 utilizes the application of heat from an auxiliary heat source, such as an electric heater or a natural gas burner, for a predetermined period of time to defrost the coils.

In one embodiment of the present invention, the improved heat pump 1 may further comprise a third heat exchanger 900. See FIG. 3B. The third heat exchanger 900 is interposed between and in connection with the second sub-circuit 104 of the first refrigerant circuit 100 and an external cooling system 800. The third heat exchanger 900 contains a portion of the second sub-circuit 104 and a portion of the external cooling system 800 in close proximity to each other within the third heat exchanger 900, such that heat energy carried by the external cooling system 800 is capable of being transferred to the first refrigerant fluid circulating within the second sub-circuit 104 of the first refrigerant circuit 100. The portion of the external cooling system 800 which is contained within the third heat exchanger 900 is the cooling system interface 810. The cooling system interface 810 connects to the remainder of the external cooling system 800, which may be a standard air plenum system, a direct expansion cooling coil, a direct cold water line, a direct cold air line, or any other conventional cooling system. The cooling system interface 810 may be a standard component of the external cooling system 800 or a new component integrated with the external cooling system 800 and specially designed to provide an interface with the improved heat pump 1. In another embodiment the third heat exchanger 900 contains the second evaporator 142 and a portion of the external cooling system 800 in close proximity to each other within the third heat exchanger 900. The third heat exchanger 900 may utilize an insulated housing that contains the portion of the second sub-circuit 104 and the portion of the external cooling system 800. Other configurations of the third heat exchanger 900 are also contemplated, as long as the first refrigerant fluid and the heat transfer medium of the external cooling system 800 remain physically separated from each other within the third heat exchanger 900.

Modifications and variations can be made to the disclosed embodiments of the invention without departing from the subject or spirit of the invention as defined in the following claims.

I claim:

1. A heat pump comprising:

a first closed refrigerant circuit, said first refrigerant circuit comprising
- a first refrigerant fluid,
- a first compressor,
- a first sub-circuit of the first refrigerant circuit,
- a second sub-circuit of the first refrigerant circuit,
- a first flow conduit, said first flow conduit suitably adapted to contain the first refrigerant fluid,
- a refrigerant expansion tank,
- a first expansion device,
- an evaporator/condenser,
- a second expansion device,
- a second evaporator, and
- a reversing valve, said reversing valve in fluid communication with and interposed between the first flow conduit and the first compressor, said reversing valve capable of being movably positioned between a first position and a second position to control the direction of flow of the first refrigerant fluid through the first flow conduit, whereby the first refrigerant fluid flows through the first flow conduit in the first direction when the reversing valve is in the first position and the first refrigerant fluid flows through the first flow conduit in the second direction when the reversing valve is in the second position;

a second closed refrigerant circuit, said second refrigerant circuit comprising
- a second refrigerant fluid, said second refrigerant fluid having a relatively lower pressure at a given temperature than that of the first refrigerant fluid, and
- a second compressor;

a first heat exchanger, said first heat exchanger interposed between and in connection with the first refrigerant circuit and the second refrigerant circuit; and a second heat exchanger, said second heat exchanger interposed between and in connection with the second refrigerant circuit and an external heating system;

wherein the first sub-circuit of the first refrigerant circuit further comprises a first portion of the first flow conduit, the first compressor, the reversing valve, the first expansion device, and the evaporator/condenser, whereby the first compressor, the reversing valve, the refrigerant expansion tank, the first expansion device, and the evaporator/condenser are in respective serial fluid communication with one another in said first sub-circuit permitting the first refrigerant fluid to circulate in a closed loop in the first direction within said first sub-circuit;

the second sub-circuit of the first refrigerant circuit further comprises a second portion of the first flow conduit, the first compressor, the reversing valve, the evaporator/condenser, the second expansion device, and the second evaporator, whereby the first compressor, the reversing valve, the evaporator/condenser, the refrigerant expansion tank, the second expansion device, and the second evaporator are in respective serial fluid communication with one another in said second sub-circuit permitting the first refrigerant fluid to circulate in a closed loop in the second direction within said second sub-circuit, and at least some part of the second portion of the first flow conduit is not coterminous with at least some part of the first portion of the first flow conduit;

the second refrigerant circuit further comprises a second flow conduit, said second flow conduit suitably adapted to contain the second refrigerant fluid, and a third expansion device, whereby the second compressor and the third expansion device are in respective serial fluid communication with one another in the second refrigerant circuit and the second refrigerant fluid circulates in a closed loop within the second refrigerant circuit;

the first heat exchanger contains a first section of the first refrigerant circuit and a first section of the second refrigerant circuit in proximity to each other within said first heat exchanger, such that heat energy carried by the first refrigerant fluid circulating within the first refrigerant circuit is capable of being transferred to the second refrigerant fluid circulating within the second refrigerant circuit;

the second heat exchanger contains a second section of the second refrigerant circuit and a first section of the external heating system in proximity to each other within said second heat exchanger, such that heat energy carried by the second refrigerant fluid circulating within the second refrigerant circuit is capable of being transferred to the external heating system;

the heat pump is operable in a heating mode when the first compressor circulates the first refrigerant fluid through the first sub-circuit of the first refrigerant circuit in a first direction and the second compressor circulates the second refrigerant fluid through the second refrigerant circuit; and the heat pump is operable in a cooling mode when the first compressor circulates the first refrigerant fluid through the second sub-circuit of the first refrigerant circuit in a second direction.

2. The heat pump of claim 1 further comprising a first check valve, a second check valve, and a third check valve, each said check valve located within the first flow conduit and permitting the flow of the first refrigerant fluid through said check valve in a single direction, wherein the first and second check valves permit the flow of the first refrigerant fluid in the first direction only and the third check valve permits the flow of the first refrigerant fluid in the second direction only, the first expansion device has an open state and a closed state, with said first expansion device in the open state permitting the flow of the first refrigerant fluid through said first expansion device in the first direction and said first expansion device in the closed state causing the flow of the first refrigerant fluid to bypass expansion within said first expansion device, and the second expansion device has an open state and a closed state, with said second expansion device in the open state permitting the flow of the first refrigerant fluid through said second expansion device in the second direction and said second expansion device in the closed state preventing the flow of the first refrigerant fluid through said second expansion device, whereby with the reversing valve in the first position, the first expansion device in the open state, and the second expansion device in the closed state the first sub-circuit of the first refrigerant circuit is operable and the first refrigerant fluid circulates in a closed loop in the first direction within the first sub-circuit, and with the reversing valve in the second position, the first expansion device in the closed state, and the second expansion device in the open state the second sub-circuit of the first refrigerant circuit is operable and the first refrigerant fluid circulates in a closed loop in the second direction within the second sub-circuit.

3. The heat pump of claim 2 further comprising one or more controllers, wherein each said controller controls at least one of the following group: the position of the reversing valve, the state of the first expansion device, and the state of the second expansion device.

4. The heat pump of claim 3 wherein at least one of the one or more controllers is a logic controller.

5. The heat pump of claim 1 further comprising one or more controllers, wherein each said controller controls operation of at least one of the following group: the first compressor and the second compressor.

6. The heat pump of claim 5 wherein at least one of the one or more controllers is a logic controller.

7. The heat pump of claim 1 wherein the first compressor is unloadable.

8. The heat pump of claim 7 further comprising a controller, wherein said controller controls operation of the first compressor, and a sensor for sensing environmental temperatures proximate to the evaporator/condenser;

wherein the sensor is in communication with the controller and the controller is responsive to input from the sensor;

whereby upon the controller receiving input from the sensor indicating the environmental temperature proximate to the evaporator/condenser has reached a first predetermined level, said controller operates the first compressor at a first capacity, and upon the controller receiving input from the sensor indicating the environmental temperature proximate to the evaporator/condenser has reached a second predetermined level, said controller operates the first compressor at a second capacity.

9. The heat pump of claim 8 wherein the controller is a logic controller.

10. The heat pump of claim 8 wherein the sensor comprises an electronic temperature sensing device.

11. The heat pump of claim 1 wherein the first refrigerant circuit further comprises one or more parallel compressors, each said parallel compressor suitably adapted to operate in parallel with the first compressor, with each said parallel compressor being stageable.

12. The heat pump of claim 1 wherein each of said first expansion device, said second expansion device, and said third expansion device comprises one of the following group: a thermal expansion valve, an electronic expansion valve, capillary tubing, orifice tubing, and a mechanical expansion valve with bypass.

13. The heat pump of claim 1 wherein each of said first expansion device and said second expansion device comprises a solenoid valve and one of the following group: capillary tubing, orifice tubing, and a mechanical expansion valve with bypass; and said third expansion device comprises one of the following group: a thermal expansion valve, an electronic expansion valve, capillary tubing, orifice tubing, and a mechanical expansion valve with bypass.

14. The heat pump of claim 1 further comprising a defrosting means sufficient to eliminate ice buildup from the evaporator/condenser.

15. The heat pump of claim 2 further comprising a defrosting means sufficient to eliminate ice buildup from the evaporator/condenser, wherein the defrosting means comprises one or more controllers, wherein said one or more controllers are suitably adapted to control the states of the first and second expansion devices, the position of the reversing valve, and operation of the first compressor, a sensor for sensing temperatures of the first refrigerant fluid proximate to the evaporator/condenser, and a timer;

wherein the sensor is in communication with at least one of the one or more controllers, the timer is in communication with at least one of the one or more controllers, and the respective one or more controllers are responsive to input from the sensor and the timer;

whereby upon the one or more controllers receiving input from the sensor indicating the temperature of the first refrigerant fluid proximate to the evaporator/condenser has reached a predetermined level, said controllers activate the timer for a predetermined period of time, set the states of the first and second expansion devices, and position the reversing valve to place the heat pump in cooling mode, and operate the first compressor such that the first refrigerant fluid flows through the second sub-circuit of the first refrigerant circuit in the second direction until the predetermined period of time elapses, and thereafter said controllers reverse the respective states of the first and second expansion devices and the position of the reversing valve to place the heat pump in heating mode and operate the first compressor such that the first refrigerant fluid flows through the first sub-circuit of the first refrigerant circuit in the first direction.

16. The heat pump of claim 15 wherein at least one of the one or more controllers is a logic controller.

17. The heat pump of claim 15 wherein the sensor comprises an electronic temperature sensing device.

18. The heat pump of claim 2 further comprising a defrosting means sufficient to eliminate ice buildup from the evaporator/condenser, wherein the defrosting means comprises one or more controllers, wherein said one or more controllers are suitably adapted to control the states of the first and second expansion devices, the position of the reversing valve, and operation of the first compressor, and a sensor for sensing temperatures of the first refrigerant fluid proximate to the evaporator/condenser;

wherein the sensor is in communication with at least one of the one or more controllers and the respective one or more controllers are responsive to input from the sensor;

whereby upon the one or more controllers receiving input from the sensor indicating the temperature of the first refrigerant fluid proximate to the evaporator/condenser has reached a first predetermined level, said controllers set the states of the first and second expansion devices, and position the reversing valve to place the heat pump in cooling mode, and operate the first compressor such that the first refrigerant fluid flows through the second sub-circuit of the first refrigerant circuit in the second direction until the sensor indicates the temperature of the first refrigerant fluid proximate to the evaporator/condenser has reached a second predetermined level, and thereafter said controllers reverse the respective states of the first and second expansion devices and the position of the reversing valve to place the heat pump in heating mode and operate the first compressor such that the first refrigerant fluid flows through the first sub-circuit of the first refrigerant circuit in the first direction.

19. The heat pump of claim 18 wherein at least one of the one or more controllers is a logic controller.

20. The heat pump of claim 18 wherein the sensor comprises an electronic temperature sensing device.

21. The heat pump of claim 1 further comprising a third heat exchanger, said third heat exchanger interposed between and in connection with the second sub-circuit of the first refrigerant circuit and an external cooling system, with the third heat exchanger containing the second evaporator and portions of the external cooling system in proximity to each other within said third heat exchanger, such that heat energy carried by the external cooling system is capable of being transferred to the first refrigerant fluid circulating within the second sub-circuit of the first refrigerant circuit.

22. The heat pump of claim 1 further comprising a third heat exchanger, said third heat exchanger interposed between and in connection with the second sub-circuit of the first refrigerant circuit and an external cooling system, with the third heat exchanger containing portions of the second sub-circuit and portions of the external cooling system in proximity to each other within said third heat exchanger, such that heat energy carried by the external cooling system is capable of being transferred to the first refrigerant fluid circulating within the second sub-circuit of the first refrigerant circuit.

23. The heat pump of claim 21 wherein the external cooling system is one of the following group: a direct expansion cooling coil, a direct cold water line, and a direct cold air line.

24. The heat pump of claim 1 wherein the external heating system is one of the following group: a boiler, a furnace, a direct hot water line, and a direct hot air line.

* * * * *